US005358170A

United States Patent [19]

Van Hest

[11] Patent Number: 5,358,170

[45] Date of Patent: Oct. 25, 1994

[54] PACKED ELECTRIC LAMP

[75] Inventor: Wilhelmus J. J. Van Hest, Eindhoven, Netherlands

[73] Assignee: U.S. Philips Corporation, New York, N.Y.

[21] Appl. No.: 183,447

[22] Filed: Jan. 18, 1994

Related U.S. Application Data

[63] Continuation of Ser. No. 35,135, Mar. 19, 1993, abandoned.

[30] Foreign Application Priority Data

Apr. 21, 1992 [EP] European Pat. Off. ..... 92201123.4

[51] Int. Cl.[5] ..... B65D 85/42

[52] U.S. Cl. ..... 229/87.02; 206/418

[58] Field of Search ..... 206/418; 229/40, 126, 229/87.02, 161

[56] References Cited

U.S. PATENT DOCUMENTS

| | | | |
|---|---|---|---|
| 2,643,814 | 6/1953 | Bradley | 206/418 |
| 2,692,077 | 10/1954 | Kuhlman | 206/418 |
| 3,134,486 | 5/1964 | Voorhies | 206/418 |
| 3,162,303 | 12/1964 | Greene | 206/418 |
| 3,255,879 | 6/1966 | Paige . | |
| 3,282,410 | 11/1966 | Cote | 206/418 |
| 3,750,934 | 8/1973 | Clinage | 206/418 |
| 4,561,542 | 12/1985 | Przepiora et al. | 206/418 |

FOREIGN PATENT DOCUMENTS

| | | | |
|---|---|---|---|
| 763787 | 7/1967 | Canada . | |
| 1015695 | 8/1952 | France | 206/418 |
| 1042137 | 10/1953 | France . | |
| 1070233 | 7/1954 | France | 206/418 |
| 1464056 | 11/1966 | France | 206/418 |
| 147385 | 10/1954 | Sweden | 206/418 |
| 861290 | 2/1961 | United Kingdom | 206/418 |

*Primary Examiner*—Gary E. Elkins
*Attorney, Agent, or Firm*—Brian J. Wieghaus

[57] ABSTRACT

The packing sleeve (10) of the packed electric lamp (1) has substantially flat walls (13–16) which are interconnected about edges (17, 17'). In a first end portion (11) of the sleeve, from an edge (17) incisions are present in adjacent walls (13, 14) to form a band (20) which is folded about creases (21) into the sleeve in order to form a pocket for the lamp cap (3). In the packed electric lamp, the band (20) clamps around the lamp cap (3) to keep the lamp fixed in the sleeve. The sleeve is a simple, reliable, cost-effective packing for an electric lamp.

5 Claims, 2 Drawing Sheets

PACKED ELECTRIC LAMP

This is a continuation of application Ser. No. 08/035,135, filed on Mar. 19, 1993, now abandoned.

BACKGROUND OF THE INVENTION

The invention relates to a packed electric lamp comprising:

an electric lamp provided with a bulb having a lamp cap;

a packing sleeve with a first and a second end portion and with substantially plane walls which are interconnected along edges, incisions being present in adjoining walls and extending from an edge in the first end portion so as to form a band which is folded inwards into the sleeve about creases extending transversely to said incisions and which in conjunction with these adjoining walls forms a pocket in which the lamp cap is accommodated, means being present for fixing the lamp in the packing sleeve.

Such a packed electric lamp is known from SE 147.385.

The known sleeve has incisions in the second end portion on either side of each edge, whereby inwardly folded strips are formed in the second end portion of the sleeve. The strips reduce the passage of the sleeve and keep the lamp fixed in the sleeve. The strips near one end and the band near the other end keep the lamp inside the sleeve at a distance from the relevant end.

A related packing is known from U.S. Pat. No. 3,134,486. in this case, incisions form a band which grips around the bulb neck at the area where this neck widens into a spherical portion. The lamp is fixed in the sleeve in that the second end portion is folded inwards in the sleeve and rests against the bulb with folds.

CA 763.787 describes a similar sleeve with a band around the widening neck of a lamp. The lamp is fixed in the sleeve in that a second sleeve has been passed around the sleeve sideways.

The known packings have the disadvantage that they require considerably more packaging material than is required for enveloping the lamp. In addition, the sleeve in the first two packings is longer than the lamp in the position in which the latter is present in the sleeve. The packed lamp as a result occupies comparatively much space in an outer container for several lamps and on a pallet.

Another disadvantage of the known packed lamp is that many operations are to be performed in order to insert the lamp into the sleeve and fix it therein.

SUMMARY OF THE INVENTION

It is an object of tile invention to provide a packed electric lamp of the kind described in the opening paragraph which comprises simple and readily manageable means for fixing the lamp in the sleeve. The invention also envisages the use of a small quantity of packaging material.

According to the invention, this object is achieved in that the band presses with clamping force against the lamp cap so as to fix the lamp in the packing sleeve.

The means fixing the lamp in the sleeve are integrated with the band. Packing of the lamp in the sleeve is very simple as a result. The lamp is inserted into the sleeve with its lamp cap facing forward and is pressed into the pocket. The lamp is thereby packed and fixed in the packing.

It was found that the sleeve offers the lamp a good protection against damage. This is also true for the embodiment in which the band is formed by only one incision in each of the relevant adjoining walls. In this embodiment, accordingly, the lamp is at the relevant end of the sleeve. The result of this may be that the lamp cap laterally projects somewhat from the sleeve with an end portion. The lamp cap, for example an Edison or bayonet lamp cap, however, has a great stiffness there, so that damage is not likely. The fact that the lamp cap projects is not disadvantageous either when the packed lamp is stacked in an outer container. This is because the sleeve can spring inwards a little, so that nevertheless a dense packing in the outer container is obtained.

The lamp may have a diagonal position in the sleeve, for example in the case of an ovoid or spherical bulb, owing to the manner in which the lamp is fixed in the sleeve. The band may then press the lamp cap against the adjoining walls from which the band was cut out. It is generally possible, also in a sleeve which is not longer than necessary for just accommodating the lamp over its full length, to form a band which rests as a buffer against the bulb opposite to the band which fixes the lamp. This, however, is not necessary for lamp fixation.

Lamps with tubular bulbs can also be packed in the sleeve. The bulb of such a lamp may have a diameter which is only slightly greater than the diameter of the lamp cap. It is advantageous in that case when the lamp occupies a substantially concentric position in the sleeve. The bulb may then be passed into the sleeve with sliding fit or with a small clearance until the lamp cap comes into contact with the band. Subsequently, the band will press against the lamp cap with clamping force.

In this embodiment, the incisions traverse the relevant adjoining wall completely or for the major part.

In contrast to the lamp neck, the lamp cap is eminently suitable for being gripped with clamping fit by the sleeve, because of its screwthread especially an Edison lamp cap. The lamp cap has a cylindrical shape, in contrast to the bulb, whose neck usually widens conically away from the lamp cap. If a band around the neck could fix the bulb at all, shifting could occur in the case of an impact, by which the bulb would become loosened and the band would lose its grip.

It is remarkable that, although the band according to the cited SE Patent surrounded the lamp cap, but without fixing the lamp thereby, technology according to the cited, much later U.S. patent and according to the cited, even later CA Patent developed in a direction which leads away from the present invention. According to this development, on the contrary, the idea of enveloping the lamp cap was indeed relinquished.

Materials which can be used for the sleeve are, for example, cardboard, such as duplex or triplex cardboard, corrugated paperboard, semi- or mini-corrugated paperboard. Those skilled in the art will readily arrive at a correct choice based on their general knowledge, in dependence on the properties of the lamp to be packed and the requirements imposed on the packed lamp.

BRIEF DESCRIPTION OF THE DRAWINGS

An embodiment of the packed lamp according to the invention is shown in the drawing, in which.

DESCRIPTION OF THE PREFERRED EMBODIMENTS

Figure 1A:
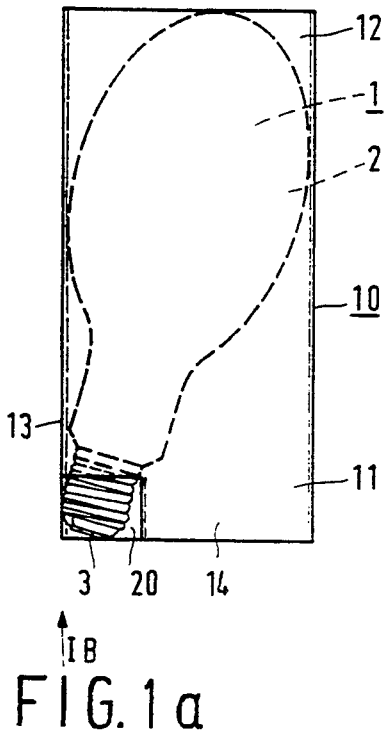
FIG. 1*a* shows a packed lamp in side elevation.
Figure 1B:
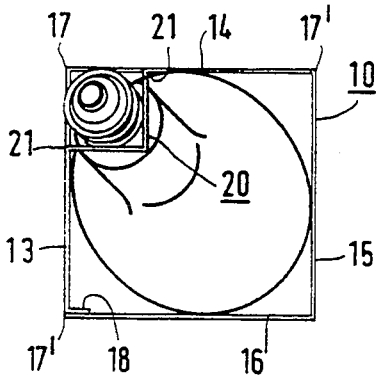
FIG. 1*b* shows the packed lamp of FIG. 1*a* taken on the line IB.

In FIG. 1, the packed electric lamp comprises an electric lamp 1 provided with a bulb 2 and a lamp cap 3. A packing sleeve 10 is open at its mutually opposing ends and has a first 11 and a second end portion 12 and substantially planar walls 13, 14, 15, 16 which are interconnected along edges 17, 17'. Incisions 19 are present in adjoining walls 13, 14 in the first end portion 11 starting from an edge 17 so as to form a band 20 which is folded inwards into the sleeve about creases 21 extending transversely to said incisions 19, thus forming in conjunction with these adjoining walls 13, 14 a pocket in which the lamp cap 3 is accommodated.

Means for fixing the lamp 1 in the packing sleeve 10 is comprised by the band 20 pressing with clamping force against the lamp cap (3) so as to fix the lamp (1) in the packing sleeve (10). In FIG. 1, the band presses the lamp cap against the adjoining walls 13, 14.

Figure 2:
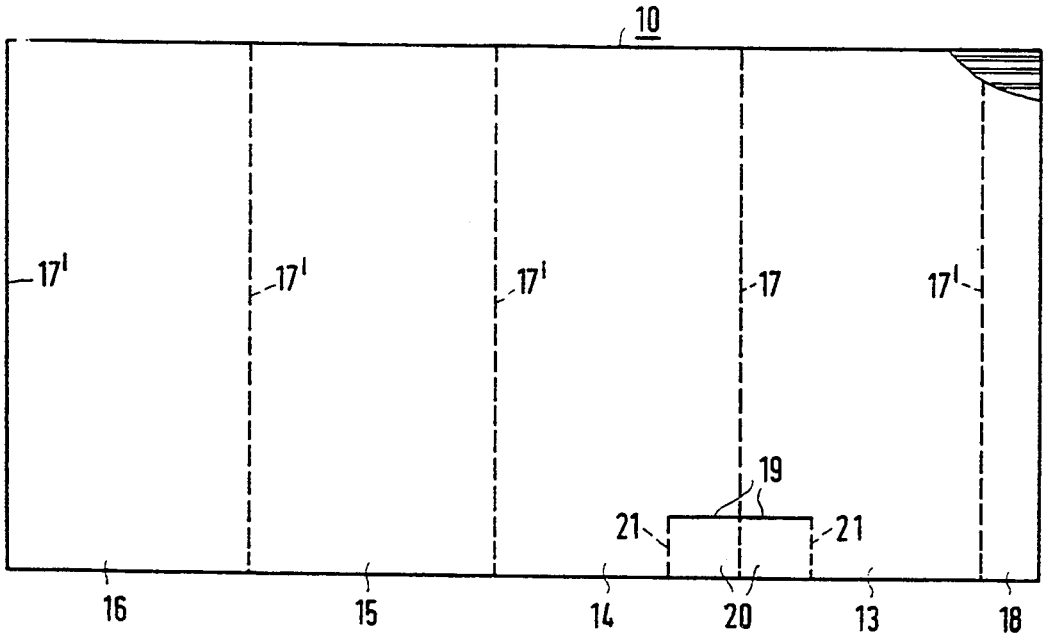
FIG. 2 shows the blank for the sleeve of FIG. 1.

The sleeve 10 may be readily formed from the blank of FIG. 2. A remarkable feature is the rectangular shape of the blank, owing to which the latter may be readily obtained from plates or sheets of packaging material with an efficient material utilization. Added to the small quantity of material in a sleeve, this renders the material consumption of the packed electric lamp according to the invention very small. Nevertheless, the packing is of high quality. The blank comprises a fixation strip 18 destined for being fixed to the wall 16 so as to form the sleeve from the blank. Staples, adhesive tape, or glue may be used, for example, for fixation. A broken-away portion of the blank shows the direction of corrugations of the corrugated board used in the drawing.

It is easy to fold the sleeve into its three-dimensional shape from the flat sleeve obtained, during or after which the band 20 is snapped into the sleeve 10. The electric lamp 1 is then inserted from the second end portion 12 into the open sleeve with its lamp cap 3 facing forwards and into the pocket formed by the band 20 and the adjoining walls 13, 14, and is pressed home. This completes the packaging operation. The open sleeve may now be held with the lamp cap up without the packing sleeve losing its grip on the lamp.

The band 20 could have been formed by means of two, for example parallel incisions in each of the adjoining walls 13, 14. The strip could then have been, for example, narrower. The lamp cap would then have lain inside the sleeve. It is possible for the sleeve to have a buffer zone between its relevant end and the lamp cap. The creases 21 around which the band 20 is folded inwards into the sleeve are perpendicular to the incisions 19 in the Figures. Alternatively, however, they could have an angle thereto which deviates by a few degrees from the perpendicular, for example, for facilitating the entrance of the lamp cap into the pocket.

In the embodiment shown, however, the band 20 is formed by only one incision 19 in each of the relevant adjoining walls 13, 14.

In a modification of the embodiment drawn, the sleeve is shaped and dimensioned with the object of keeping two lamps facing in opposite directions fixed in respective pockets.

An advantage of the packed electric lamp according to the invention over the circular sleeve packing customary for some lamp types is that the sleeve has substantially planar walls. This prevents the packed lamp from rolling down a sloping surface. This is important, for example, for street lighting lamps which are to be provided in a luminaire from a raised platform. It is also important in this respect that the lamp can be easily taken from the packaging and that little packaging material of small volume is left behind.

Figure 3A:
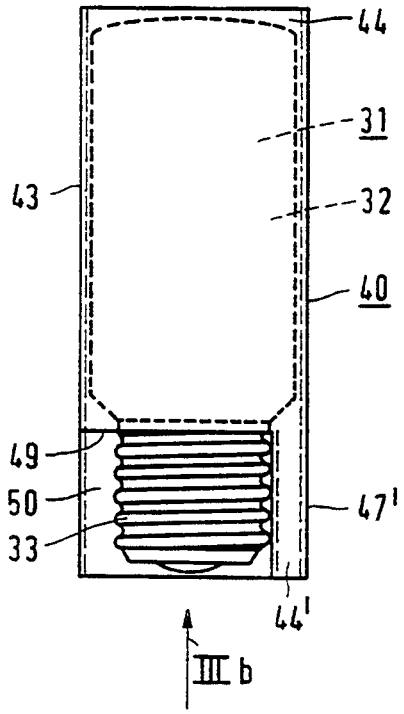
FIGS. 3*a, b* is a modification of FIGS. 1*a, b.*
Figure 3B:
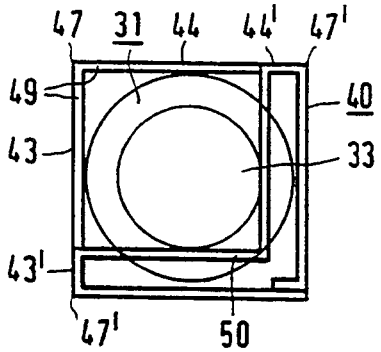

In FIGS. 3*a, b,* parts corresponding to those of FIGS. 1*a, b* have reference numerals which are 30 higher than in FIGS. 1*a, b.*

The lamp 31 is arranged concentrically in the sleeve 40 and has a tubular bulb 32 which is enclosed in the sleeve with sliding fit or with a slight clearance. The bulb 32 has a diameter which is only a little greater than that of the lamp cap 33. In the embodiment drawn, however, the diameter difference is more than twice the material thickness of the sleeve. The incisions 49 in the adjoining walls 43, 44 as a result do traverse these walls substantially, but not completely. A small portion 43', 44' of each wall is not incised. Without a diameter difference or with a very small diameter difference the incisions 49 could extend up to the edges 47'.

The lamp may be introduced into the sleeve with little friction with its lamp cap facing forward, until the moment the lamp cap 33 arrives at the band 50. Then the lamp cap enters its pocket, and the latter will clamp itself against the lamp cap and fix it in place.

I claim:

1. A packed electric lamp comprising an electric lamp having a bulb and a lamp cap;

a packing sleeve with a first and a second end portion and with planar walls interconnected along longitudinally extending edges of said sleeve, a band formed from two adjoining walls of said planar walls which is folded inwards into the sleeve and which in conjunction with the two adjoining walls forms a pocket in which the lamp cap is accommodated, and fixing means for axially fixing the lamp in the packing sleeve, characterized in that: said fixing means consists essentially of the band pressing with clamping force against the lamp cap so as to axially fix the lamp in the packing sleeve, and said band is at one end of said sleeve and is formed by only one incision in each of said adjoining walls from which said band is formed.

2. A packed electric lamp, comprising:

a) an electric lamp having a bulb and lamp cap; and b) a packing sleeve enclosing an interior and in which the electric lamp is fixed, said packing sleeve having a length dimension and including (i) a plurality of planar walls extending longitudinally between opposing ends of said sleeve and interconnected along edges extending parallel to the length dimension of said sleeve and (ii) a fixing band at one of said ends of said sleeve formed from two adjoining walls of said planar walls and folded into the interior of said sleeve, said band being formed by only one incision and one crease in each of said two adjoining walls, said incisions extending substantially transverse to the length dimension and said crease extending substantially paralle to the length dimension, one of said sleeve ends being completely open and said other sleeve end being open except for said interiorly folded band, said band being dimensioned such that said lamp cap is insertable therein with a clamping fit sufficient to axially retain said lamp within said sleeve, and said sleeve being free of other fixing elements engaging said lamp bulb for axially securing said lamp in the sleeve.

3. A packed electric lamp according to claim 2, wherein said lamp bulb has a diameter substantially larger than said lamp cap, and said band secures said lamp cap in a corner portion of said sleeve and said lamp extends diagonally within said sleeve.

4. A packed electric lamp according to claim 2, wherein said lamp bulb is tubular and has a diameter only slightly greater than said lamp cap, said band extends across the major portion of said two adjoining walls, and said lamp is aligned with the length dimension of said sleeve.

5. A packed electric lamp according to claim 2, wherein said lamp is substantially flush with both of said ends of said sleeve.

* * * * *